US007326674B2

(12) United States Patent
Sheirs et al.

(10) Patent No.: US 7,326,674 B2
(45) Date of Patent: Feb. 5, 2008

(54) HOUSEHOLD CLEANING COMPOSITION IN SELF-SUSTAINING BODY FORM AND ESSENTIALLY FREE OF ZEOLITE AND CLAY

(75) Inventors: Dennis Sheirs, Sebring, FL (US); Brandy Padilla, Winter Haven, FL (US); Donald Wall, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 11/672,805

(22) Filed: Feb. 8, 2007

(65) Prior Publication Data

US 2007/0129279 A1 Jun. 7, 2007

Related U.S. Application Data

(63) Continuation of application No. 11/124,712, filed on May 9, 2005, now abandoned.

(51) Int. Cl.
*C11D 7/12* (2006.01)
*C11D 3/39* (2006.01)
*C11D 1/12* (2006.01)

(52) U.S. Cl. ..... 510/224; 510/220; 510/229; 510/233; 510/238; 510/252; 510/294; 510/302; 510/310; 510/318; 510/367; 510/372; 510/446; 510/447; 510/477; 510/509

(58) Field of Classification Search ..... 510/220, 510/224, 229, 233, 238, 252, 294, 302, 310, 510/318, 367, 372, 446, 447, 477, 509
See application file for complete search history.

(56) References Cited

U.S. PATENT DOCUMENTS

2006/0166848 A1 7/2006 De Dominicis et al.

*Primary Examiner*—Charles Boyer
(74) *Attorney, Agent, or Firm*—Hovey Williams LLP

(57) ABSTRACT

New cleaning compositions and methods of forming and using those compositions are provided. In a preferred embodiment, the compositions are in tablet form, with the tablets being dissolvable in water at the point-of-use for ease of storing and shipping. The compositions comprise sodium bicarbonate, citric acid, an alkali metal alkylbenzene sulfonate, an ingredient selected from the group consisting of a trialkyl glycol monoalkyl ether, limonene, and mixtures thereof, and other ingredients depending upon the embodiment. The diluted cleaner has a very low impact on the environment due to the low levels of surfactants in the diluted solution. Furthermore, the cleaning solution performs well on protein stains due to the production of $CO_2$ and the presence of sodium perborate. The inventive composition can be used on a wide range of substrates, from hard surfaces to fabrics.

12 Claims, No Drawings

HOUSEHOLD CLEANING COMPOSITION IN SELF-SUSTAINING BODY FORM AND ESSENTIALLY FREE OF ZEOLITE AND CLAY

RELATED APPLICATIONS

The present application is a continuation of nonprovisional patent application Ser. No. 11/124,712, filed May 9, 2005, now abandoned, titled HOUSEHOLD CLEANING COMPOSITION, the teachings and content of which are incorporated by reference herein.

BACKGROUND OF THE INVENTION

1. Field of the Invention

The present invention is broadly concerned with a new cleaning composition that can be used for household or industrial cleaning purposes. The composition can be in powder form, in an aqueous solution, or in the form of a tablet.

2. Description of the Prior Art

Relatively mild general purpose cleaners have long been sought for purposes such as household cleaners, grease cutters, and hard-surface cleaners. Previously, many such cleaners relied on harsh alkaline sources such as alkali metal and alkaline earth metal hydroxides to reduce critical micelle concentration, neutralize acids, stabilize solid soil suspensions, and solubilize water-insoluble materials. While effective, these cleaners were highly caustic, and as such, were difficult and dangerous to use. Milder cleaners were developed using less caustic bases as alkalinity sources, but these were only effective for limited uses because of their decreased cleaning efficiency and grease-cutting properties.

Many detergents consisting of alkaline carbonates, anionic and nonionic surfactants, and sequestrants have been described previously. Anionic surfactants include compounds such as alkyl carboxylates, alkyl sulfates, and alkyl benzene sulfonates, and are useful for removing oily soils and stains. Some anionic surfactants significantly increase the foaming of detergent formulations. This problem is sometimes addressed by the addition of defoaming agents, but many of these compounds, such as silicones, oils, fats, and waxes, add expense and bulk to cleaning products. Nonionic surfactants generally improve rinse properties of cleaning compounds and include compounds such as linear alcohol ethoxylates, nonyl phenol ethoxylates, and other polyoxyalkylene compounds. Cleaners containing nonyl phenol ethoxylates have only limited uses, as they are inappropriate for cleaning surfaces that come in contact with food items.

Sequestrants are included to bind water hardness-causing ions to improve the cleaning action of detergents. Common examples include chelating agents such as EDTA, NTA, and organic phosphates such as phosphonic acids, sodium tripolyphosphate, and tetrapotassium phosphate. EDTA may be harmful to the environment because it is not readily biodegradable. Inorganic phosphates have recently been shown to be harmful to the environment.

Cleaners in the form of rapidly dissolving pre-measured tablets or pellets are also desirable. Such formulations eliminate uncertainty associated with measuring liquids or powders, and reduce the necessity of handling cleaning compositions. Producing pre-measured pellets or tablets using high concentrations of sodium carbonate have presented some problems, as they tend to absorb water and swell and crack over time. This problem has been addressed by using anhydrous alkaline carbonates to reduce the large amounts of water in cleaning tablets.

There is a need for relatively mild cleaners with good grease cutting capabilities and increased cleaning efficiency. These cleaners should also be stable, and have long shelf lives.

SUMMARY OF THE INVENTION

The present invention overcomes these problems by providing a new cleaning composition that cleans well without harming the surface to be cleaned.

In more detail, the cleaning composition comprises sodium bicarbonate, an acid (e.g., citric acid), an alkali metal alkylbenzene sulfonate, and a degreaser such as those selected from the group consisting of a glycol ethers (e.g., trialkyl glycol monoalkyl ethers), limonene, and mixtures thereof.

The sodium bicarbonate is preferably present in the composition at a level of from about 30-70% by weight, preferably from about 35-60% by weight, and even more preferably from about 40-55% by weight, based upon the total weight of the composition taken as 100% by weight.

In one embodiment, the acid is present in the composition at low levels, e.g., less than about 25% by weight, preferably from about 8-25% by weight, and even more preferably from about 10-20% by weight, based upon the total weight of the composition taken as 100% by weight. In other embodiments, the acid is present in the composition at a level of from about 25-45% by weight, and even more preferably from about 30-38% by weight, based upon the total weight of the composition taken as 100% by weight.

Preferred alkali metal alkylbenzene sulfonates include sodium dodecyl benzene sulfonates such as the one sold under the name CALSOFT F-90 (available from Pilot Chemical Company, Santa Fe Springs, Calif.). The alkali metal alkylbenzene sulfonates are preferably present in the composition at a level of from about 0.5-15% by weight, more preferably from about 1-8% by weight, and even more preferably from about 1-4% by weight, based upon the total weight of the composition taken as 100% by weight.

The degreaser is present at a level of from about 0.5-25% by weight, preferably from about 1.5-21% by weight, more preferably from about 4-13% by weight, and even more preferably from about 2-6% by weight, based upon the total weight of the composition taken as 100% by weight.

In one embodiment, the composition further comprises a source of phosphates, with preferred phosphates being those selected from the group consisting of sodium tripolyphosphate, trisodiumphosphate, tetrapotassium pyrophosphate, and mixtures thereof. When included, the source of phosphates should be such that phosphates are included in the composition at a level of from about 1-10% by weight, preferably from about 1-6% by weight, and even more preferably from about 2-5% by weight, based upon the total weight of the composition taken as 100% by weight. In another embodiment, the composition includes a compound selected from the group consisting of sodium per carbonate, sodium perborate, and mixtures thereof. When used, this compound is present in the composition at a level of from about 5-10% by weight, preferably from about 6-8% by weight, and even more preferably from about 7-8% by weight, based upon the total weight of the composition taken as 100% by weight.

Advantageously, an embodiment is provided that contains nonylphenlol ethoxylates where this is desirable for the particular application, while an alternative embodiment is provided for those situations where the environmental impact of nonylphenol ethoxylates must be avoided. If nonylphenol ethoxylates are present, they are included at levels of from about 0.5-4% by weight, preferably from about 0.5-2.5% by weight, and even more preferably from about 0.75-2.0%by weight, based upon the total weight of the composition taken as 100% by weight.

Preferred nonylphenol ethoxylates have from about 5-10 moles, and more preferably from about 5-7 moles of ethylene oxide per mole of nonylphenol. One preferred nonylphenol ethoxylate is available under the name NP-7 (from Union Carbide). Another is available under the name Makon 12 (from Stepan Company, Northfield, Ill.).

In the environmentally-friendly embodiments, the composition is preferably essentially free of nonylphenol ethoxylates and alcohol ethoxylates. Thus, the composition comprises less than about 0.05% and preferably about 0% by weight nonylphenol ethoxylates and alcohol ethoxylates, based upon the total weight of the composition taken as 100% by weight.

The compositions of the invention can also include a number of optional ingredients. For example, the compositions may comprise a hydrotrope such as sodium xylene sulfonate (sold under the name Pilot SXS-96 by Pilot Chemical Company) and sodium cumene sulfonate. When included, the hydrotrope should be present at a level of from about 0.5-5% by weight, preferably from about 1-4% by weight, and even more preferably from about 0.5-2.5% by weight, based upon the total weight of the composition taken as 100% by weight.

An emulsifier can also be included at levels of from about 1-15% by weight, preferably from about 1-10% by weight, and even more preferably from about 2-6% by weight, based upon the total weight of the composition taken as 100% by weight. Preferred emulsifiers include sodium lauryl sulfate (e.g., ME-DRY, available from Stepan Company, Northfield, Ill.) and polyethylene glycol (e.g., PEG 8000, available from Union Carbide).

The composition may also include one or more builders such as potassium hydroxide (which also acts to increase the pH). The builder should be present in the composition at a level of from about 0.5-10% by weight, from about 1-5% by weight, and even more preferably from about 1-3% by weight, based upon the total weight of the composition taken as 100% by weight.

In one embodiment, the compositions may include an alcohol ethoxylate. In embodiments where an alcohol ethoxylate is utilized, it is preferably present at a level of from about 0.5-4% by weight, and more preferably from about 0.5-2% by weight, based upon the total weight of the composition taken as 100% by weight. Preferred alcohol ethoxylates comprise from about 5-7 moles of ethylene oxide per mole of alcohol. One preferred alcohol ethoxylate is BEROL 260® (available from Akzo-Nobel).

Another unique feature of the present invention is that binders (e.g., standard binders, clay, zeolites, etc.) are not necessary to form the inventive mixtures into a self-sustaining body (e.g., tablet). Thus, the present compositions are preferably essentially free of binders (i.e., less than about 0.05% by weight, and preferably about 0% by weight binders, based upon the total weight of the composition taken as 100% by weight).

DETAILED DESCRIPTION OF THE PREFERRED EMBODIMENTS

The are several acceptable methods of making the inventive compositions. In one method, two premixes are formed by mixing the appropriate ingredients together until uniform. The first premix comprises the d-limonene and isopropyl amine.

The second premix comprises a detergent (preferably anionic, such as sodium dodecyl benzene sulfonate), hydrotrope (e.g., sodium xylene sulfonate; sodium cumene sulfonate), sodium lauryl sulfate, and any silicon dioxide and dyed ash that may be used.

The first premix is then mixed with all other ingredients except the second premix, the acid, and the tipropylene glycol monomethyl ether. This mixture is tumbled for a time period of from about 20-40 minutes, and preferably for about 30 minutes. Preferably, an intensifier bar is then turned on, and mixing is continued for about 20-40 minutes, and preferably about 30 minutes longer.

The acid is then added to the mixture and tumbled for an additional time period of from about 40-80 minutes, and more preferably for about 60 minutes. The resulting material is preferably chilsonated at a pressure of from about 6,000-10,000 pounds, and more preferably at about 8,000 pounds of pressure, and then granulated in a comparator using a 2A screen. The tripropylene glycol monomethyl ether and second premix are then added, and the mixture is placed in a mixer and tumbled for a time period of from about 15-60 minutes, and more preferably for about 45 minutes. The resulting material is allowed to rest for a time period of from about 20-28 hours, and more preferably about 24 hours, before being pressed into tablets. This method is shown in detail in Examples 1 and 2.

Regardless of the mixing procedure, the composition can be formed into a self-sustaining body using conventional methods. Alternatively, it has been found that pressing the composition into a tablet is made easier by modifying the tooling of a conventional press so that the upper punch is made into two pieces with a spring and pin insert. This allows for the punch to more readily release from the tablet after the composition is compressed.

It is preferred that the final tablet (or otherwise shaped self-sustaining body) has a moisture content of from about 0.1-0.8% by weight, and more preferably from about 0.1-0.4% by weight, based upon the total weight of the tablet taken as 100% by weight. Furthermore, the bulk density of the body is preferably from about 1.2-1.4 g/cm$^3$, and more preferably from about 1.3-1.4 g/cm$^3$, while the actual density of the body is preferably from about 1.2-1.3 g/cm$^3$, and more preferably from about 1.2-1.25 g/cm$^3$.

It will be appreciated that the composition described above was not diluted in water (i.e., it was the concentrated cleaning composition), but it can be dissolved or dispersed in a solvent system such as water at the time of use. Preferably, the composition (either in powder form or pressed form) is diluted in water at sufficient levels that the final aqueous cleaning solution comprises from about 0.3-1.5% by weight, more preferably from about 0.3-1.2% by weight, and even more preferably from about 0.3-1.0% by weight of the cleaning composition, based upon the total weight of the diluted, aqueous cleaning solution taken as 100% by weight.

It will be appreciated that the cleaning compositions are highly soluble in water. That is, the cleaning compositions are at least about 95%, preferably at least about 98%, and even more preferably about 100% dissolved in water about 3 minutes after mixing with water (preferably at a temperature of from about 115-125° F., and more preferably about 118° F.) is commenced (assuming the dilution ratios discussed above). The resulting cleaning solution comprises $CO_2$, sodium ions, citrate ions, and a surfactant.

Advantageously, the diluted, aqueous cleaning solution includes high levels of $CO_2$. That is, at a time period of about 3 minutes after combining the cleaning composition with water, the aqueous cleaning solution will have at least about 0.02% by weight $CO_2$, preferably at least about 0.025% by weight $CO_2$, and more preferably from about 0.01-0.03% by weight $CO_2$, based upon the total weight of the aqueous cleaning solution taken as 100% by weight.

The diluted, aqueous cleaning solution will also have a fairly neutral pH. The pH of the aqueous cleaning solution (at the dilution levels discussed previously) will be from about 6.5-7.9, and more preferably from about 6.5-7.5.

The diluted, aqueous cleaning solution will also preferably contain very low levels of surfactants, thus minimizing and preferably avoiding a negative impact on the environment. Specifically, the aqueous cleaning solution will have a total surfactant content of less than about 0.6% by weight, more preferably less than about 0.5% by weight, and even more preferably from about 0.1-0.3% by weight, based upon the total weight of the composition taken as 100% by weight.

The aqueous cleaning solution will comprise from about 0.10-0.15% by weight sodium ions, and preferably from about 0.10-0.12% by weight sodium ions, based upon the total weight of the aqueous cleaning solution taken as 100% by weight. The aqueous cleaning solution will comprise from about 0.20-0.35% by weight citrate ions, and preferably from about 0.25-0.35% by weight citrate ions, based upon the total weight of the aqueous cleaning solution taken as 100% by weight. Finally, the aqueous cleaning solution will comprise from about 0.25-0.50% by weight surfactant, and preferably from about 0.25-0.35% by weight surfactant, based upon the total weight of the aqueous cleaning solution taken as 100% by weight.

EXAMPLES

The following examples set forth preferred methods in accordance with the invention. It is to be understood, however, that these examples are provided by way of illustration and nothing therein should be taken as a limitation upon the overall scope of the invention.

Example 1

1. Preparation of D-Limonene Premix

In this example, a mixture of 60% d-limonene and 40% isopropyl amine is prepared by dissolving d-limonene into isopropyl amine. The mixture was mixed until uniform using a standard propeller mixer.

2. Preparation of P % Premix

In this example, a mixture consisting of 43% sodium dodecyl benzene sulfonate, 18% sodium xylene sulfonate, 26% sodium lauryl sulfonate, 3% silicon dioxide, and 10% dyed soda ash were placed in a V-mixer. The mixture was tumbled for 45 minutes.

3. Preparation of Phosphate-Free Cleaning Composition

A cleaning composition having the formula of Table A was prepared.

TABLE A

| INGREDIENT | % BY WEIGHT |
|---|---|
| Sodium Carbonate (Soda Ash) | 5.36 |
| D-Limonene Premix (Prepared in Part 1 of this Example) | 2.29 |
| Sodium Bicarbonate (Baking Soda) | 52.98 |
| Sodium Percarbonate | 8.58 |
| Trisodium Nitrilotriacetate Monohydrate | 2.29 |
| Citric Acid | 18.10 |
| Defoaming Agent | 0.90 |
| Tripropyl Glycol Monomethyl Ether | 2.50 |
| P % Premix (Prepared in Part 2 of this Example) | 7.0 |

In this procedure, the soda ash, d-limonene premix, baking soda, sodium percarbonate, defoaming agent and trisodium nitrilotriacetate monohydrate were combined in a V-mixer (could be carried out by any known powder mixing technique) and tumbled for 30 minutes. After 30 minutes, the intensifier bar was turned on, and the mixture continued to stir for another 30 minutes. The citric acid was added to the mixture and tumbled for an additional hour. The resulting material was chilsonated at 8,000 pounds of pressure, and then granulated in a commutator using a 2A screen. The tripropylene glycol monomethyl ether and P % premix were added and placed in a V-mixer and tumbled for 45 minutes. The resulting material rested for 24 hours before being pressed into tablets.

Table B shows the broadest and preferred ranges of the various components for forming a phosphate-free cleaning composition according to the invention.

TABLE B

| INGREDIENT | BROAD RANGE % BY WEIGHT | PREFERRED RANGE % BY WEIGHT |
|---|---|---|
| Sodium Carbonate (Soda Ash) | 1-10 | 2-8 |
| D-Limonene | 0.5-2 | 1-2 |
| Isopropyl Amine | 0.5-1 | 0.5-0.8 |
| Sodium Bicarbonate (Baking Soda) | 30-70 | 40-60 |
| Sodium Percarbonate[1] | 4-10 | 6-9 |
| Trisodium Nitrilotriacetate Monohydrate[2] | 1-10 | 2-6 |
| Citric Acid[3] | 10-40 | 15-30 |
| Defoaming Agent | 0.1-1 | 0.5-1 |
| Sodium Dodecyl Benzene Sulfonate[4] | 1-9 | 3-6 |
| Tripropyl Glycol Monomethyl Ether | 1-3.5 | 1.5-2.5 |
| Sodium Lauryl Sulfonate[5] | 0.5-3 | 1-2 |
| Sodium Xylene Sulfonate[6] | 0.5-3 | 1-2 |
| Blue Ash | 0.05-1 | 0.05-0.1 |

[1]Or sodium perborate or mixture of sodium perborate and sodium percarbonate.
[2]Or other chelating agent (e.g., Dissolvine, EDTA).
[3]Or other acid.
[4]Or other detergent, preferably anionic (e.g., F-90).
[5]Such as SLS-90 (90% active powder).
[6]Preferably 96% active and preferably anionic.

Example 2

Preparation of Cleaning Composition with Phosphates

A cleaning composition having the formula of Table C was prepared.

TABLE C

| INGREDIENT | % BY WEIGHT |
|---|---|
| Sodium Carbonate (Soda Ash) | 2.56 |
| Sodium Tripolyphosphate | 2.92 |
| D-Limonene Premix (Prepared in Part 1 of Example 1) | 2.28 |
| Sodium Bicarbonate (Baking Soda) | 51.41 |
| Tetrapotassium Phosphate | 9.60 |
| Trisodium Nitrilotriacetate Monohydrate | 2.35 |
| Citric Acid | 18.00 |
| Defoaming Agent | 0.90 |
| Tripropyl Glycol Monomethyl Ether | 2.50 |
| P % Premix (Prepared in Part 2 of Example 1) | 7.48 |

In this procedure, soda ash, sodium tripolyphosphate, d-limonene premix, baking soda, tetrapotassium phosphate, trisodium nitrilotriacetate monohydrate, and defoaming agent were combined in a V-mixer and tumbled for 30 minutes. After 30 minutes, the intensifier bar was turned on, and the mixture continued to stir for another 30 minutes. The citric acid was added to the mixture and tumbled for an additional hour. The resulting material was chilsonated at 8,000 pounds of pressure, and then granulated in a commutator using a 2A screen. The tripropylene glycol monomethyl ether and P % premix were added and placed in a V-mixer and tumbled for 45 minutes. The resulting material rested for 24 hours before being pressed into tablets.

Table D shows the broadest and preferred ranges of the various components for forming a phosphate-containing cleaning composition according to the invention.

TABLE D

| INGREDIENT | BROAD RANGE % BY WEIGHT | PREFERRED RANGE % BY WEIGHT |
|---|---|---|
| Sodium Carbonate (Soda Ash) | 1-10 | 2-8 |
| Sodium Tripolyphosphate[1] | 1-6 | 2-5 |
| D-Limonene | 0.5-2 | 1-3 |
| Isopropyl Amine | 0.2-1.5 | 0.4-1.2 |
| Sodium Bicarbonate (Baking Soda) | 30-70 | 40-60 |
| Tetrapotassium Phosphate[1] | 3-15 | 7-12 |
| Trisodium Nitrilotriacetate Monohydrate[2] | 1-5 | 2-3 |
| Citric Acid[3] | 10-25 | 15-20 |
| Defoaming Agent | 0.5-2 | 0.5-1.5 |
| Sodium Dodecyl Benzene Sulfonate[4] | 1-15 | 2-8 |
| Tripropyl Glycol Monomethyl Ether | 1-5 | 1-3 |
| Sodium Lauryl Sulfonate[5] | 1-5 | 1-4 |
| Sodium Xylene Sulfonate[6] | 0.5-3 | 0.5-2 |
| Blue Ash | 0.5-3.5 | 0.5-1.5 |

[1]Or other phosphate-containing detergent or builder.
[2]Or other chelating agent (e.g., Dissolvine, EDTA).
[3]Or other acid.
[4]Or other detergent, preferably anionic (e.g., F-90).
[5]Such as SLS-90 (90% active powder).
[6]Preferably 96% active and preferably anionic.

Example 3

1. Preparation of SPB/IPA

SPB/IPA is a mixture of 70-80% by weight sodium perborate and 20-30% by weight isopropyl alcohol. The mixture can be prepared using most known powder-blending techniques. A mixing vessel was charged with sodium perborate, and mixing was commenced. The isopropyl alcohol was added during mixing, and mixing was continued until uniform.

2. Preparation of SPB/260

SPB/260 is a degreaser that is a mixture of 70-80% by weight sodium perborate and 20-30% by weight Berol 260 (alcohol ethoxylate, available from Akzo-Nobel). The Berol 260 can be substituted with a nonylphenol ethoxylate or other alcohol ethoxylate having about 5-7 moles of ethylene oxide per mole of nonylphenol or alcohol.

A mixing vessel was charged with sodium perborate, and mixing was commenced. The Berol 260 was added during mixing, and mixing was continued until uniform.

3. Preparation of Composition

A household cleaning composition having the formulation set forth in Table E was prepared.

TABLE E

| INGREDIENT | % BY WEIGHT |
|---|---|
| SPB/IPA (Prepared in Part 1 of this Example) | 6.91 |
| SPB/260 (Prepared in Part 2 of this Example) | 6.91 |
| Sodium Dodecyl Benzene Sulfonate (F-90) | 2.49 |
| Sodium Lauryl Sulfate (ME-DRY) | 1.38 |
| Sodium Xylene Sulfonate (SXS-96) | 1.38 |
| Trisodium Nitrilotriacetate Monohydrate | 2.77 |
| Sodium Carbonate (Soda Ash) | 4.98 |
| Tripropyl Glycol Monomethyl Ether | 0.97 |
| Fragrance | 0.07 |
| Sodium Bicarbonate (Baking Soda) | 39.80 |
| Citric Acid | 31.84 |
| Blue Ash (Dyed Sodium Carbonate) | 0.50 |

A mixing vessel was charged with SPB/IPA, SPB/260, sodium dodecyl benzene sulfonate, sodium xylene sulfonate, sodium lauryl sulfate, trisodium nitrilotriacetate monohydrate, blue ash, and sodium carbonate. Mixing was carried out until uniform. While the mixer was running, the tripropyl glycol monomethyl ether and fragrance were added, and mixing was continued until uniform. After mixing was complete, the mixture was placed in a sealed container. The material was allowed to rest until the granules reduced in size. The mixture was compacted and granulated using a roll compactor and commutator. This mixture was then mixed with the citric acid and sodium bicarbonate until uniform. The mixture was allowed to set for 24 hours prior to pressing.

Example 4

Testing of Cleaning Properties

An inventive composition having the formula set forth in Table F was prepared.

TABLE F

| INGREDIENT | % BY WEIGHT |
|---|---|
| Na Ash/260[A] | 4.60 |
| D-Lime Premix (As Prepared in Part 1 of Example 1) | 1.75 |
| Sodium Bicarbonate (Baking Soda) | 40.00 |
| Sodium Dodecyl Benzene Sulfonate (F-90) | 3.00 |
| Sodium Perborate | 8.40 |
| Trisodium Nitrilotriacetate Monohydrate | 2.70 |
| Fragrance | 0.15 |

TABLE F-continued

| INGREDIENT | % BY WEIGHT |
|---|---|
| Sodium Percarbonate | 1.95 |
| Citric Acid | 35.50 |
| Sodium Xylene Sulfonate (SXS-96) | 1.95 |
| Blue Ash | 0.50 |

[A]Na Ash/260 is a degreaser that is a mixture of 80-90% by weight soda ash (sodium carbonate) and 10-20% by weight Berol 260. The two ingredients are mixed in a mixing vessel until uniform.

The composition was diluted in water by adding 1% by weight of the cleaning composition to water. The composition was then subjected to ASTM D4488 and Federal Specification PD1747C. The testing was performed on three different types of substrates with different types of soils. Initial reflectance readings were taken on three vinyl panels and three aluminum panels using a Micro TriGloss Meter with 60° geometry. Each panel was then coated with standard dirt (Sanders and Lambert Modified Urban Soil) and baked for one hour at 100° C. The panels were allowed to cool, and a second reflectance measurement was taken. A panel was then placed in a Washability Tester equipped with a standard sponge. The panel was then sprayed with two sprays of cleaner, and the cleaner was allowed to soak into the soil for 30 seconds. The Washability Tester was switched on and allowed to complete five scrubbing cycles. The panel was removed, and a final reflectance value was determined in the cleaned area of the panel. This process was repeated for the remaining panels.

In the second test, painted wallboard was used as the substrate to be cleaned. Twelve panels were used, and reflectance values were determined prior to soiling as described above. Three panels were then soiled with lipstick, three panels were coated with #2 pencils, three panels were coated with a 50/50 blend of motor oil and Crisco®, and three panels were coated with ASTM standard grease. The panels soiled with lipstick and the 50/50 oil/Crisco® blend were then baked at 50° C. for two hours and then allowed to cool. Reflectance measurements were then taken for each soiled panel, and the panels were subjected to the same cleaning process described above. After cleaning, final reflectance measurements were taken.

All of the oily or greasy soils as well as the dirt and pencil were readily removed by the composition. The inventive composition was able to remove most of the lipstick as well.

Example 5

Testing of Cleaning Properties

A second set of cleaning tests was performed exactly as described in Example 4 except that weight measurements were taken rather Klan reflectance measurements. Thus, the same types of substrates and soils were used, and the weight of the particular substrate as a clean panel was determined and recorded. After soiling of the panel, the weight was recorded again. This was deemed the "initial weight," unless the substrate was baked, in which case the weight determined after baking was the "initial weight."

The panels were then cleaned as described above. After cleaning, the panels were allowed to dry, and the respective weights of the panels were determined and recorded. This was deemed the "final weight." Using the weight measurements, the percent of soil removed by the cleaning process was calculated. This was calculated by the following formula:

$$\%\ \text{soil removed} = \left(\frac{\text{initial weight} - \text{final weight}}{\text{initial weight}}\right) \times 100.$$

The percent of soil removed is shown in Tables G and H.

TABLE G

| CLEANER | VINYL[A] | ALUMINUM[A] |
|---|---|---|
| Table E Formula (70° F. dilution) | 3.38% | 4.26% |
| Table D Formula (115° F. dilution) | 3.26% | 4.66% |
| Lysol ® Antibacterial Kitchen Cleaner | 5.53% | 9.01% |
| Formula 409 ® | 3.06% | 5.04% |
| Fantastik ® Oxy Power | 1.52% | 1.39% |
| Spic 'n Span ® Cinch | 3.19% | 0.79% |

[A]Modified Sanders and Lambert Urban Soil.

TABLE H

| CLEANER | PENCIL[A] | ASTM GREASE[A] | 50/50 Motor oil/ Crisco ®[A] | Lip-stick[A] |
|---|---|---|---|---|
| Table E Formula (70° F. dilution) | 25.00% | 62.30% | 75.00% | 9.00% |
| Table D Formula (115° F. dilution) | 12.00% | 57.48% | 12.09% | 9.09% |
| Lysol ® Antibacterial Kitchen Cleaner | 50.00% | 77.16% | 58.76% | 89.00% |
| Formula 409 ® | 0.00% | 71.82% | 26.39% | 42.86% |
| Fantastik ® Oxy Power | 0.00% | 73.98% | 18.96% | 22.82% |
| Spic 'n Span Cinch ® | 0.00% | 53.18% | 9.22% | 12.10% |

[A]Wallboard substrate.

The respective pH values of the various cleaners are shown in Table I.

TABLE I

| CLEANER | pH |
|---|---|
| Table E Formula (70° F. dilution) | 6.76 |
| Table D Formula (115° F. dilution) | 6.69 |
| Lysol ® Antibacterial Kitchen Cleaner | 10.79 |
| Formula 409 ® | 11.76 |
| Fantastik ® Oxy Power | 3.15 |
| Spic 'n Span Cinch ® | 10 |

These results show that the inventive cleaning solutions cleaned standard soil comparable to some competitive cleaners. Furthermore, the inventive cleaning solutions did very well on greasy stains even though the pH values of the inventive solutions were fairly neutral. Thus, at pH ranges of from about 6.5-7.9, the inventive solutions will remove at least about 50%, preferably at least about 60%, and even more preferably at least about 70% of greasy stains when subjected to the cleaning test described in this Example.

We claim:

1. A cleaning composition comprising a mixture including:

sodium bicarbonate;

citric acid;

an alkali metal aikylbenzene sulfonate;

an ingredient selected from the group consisting of a trialkyl glycol monoalkyl ether, limonene, and mixtures thereof; and a compound selected from the group consisting of sodium percarbonate, sodium perborate, and mixtures thereof, said composition being in the form of a self-sustaining body and being essentially free of binders, zeolite, and clay.

2. The composition of claim 1, wherein said composition is essentially free of nonylphenol ethoxylates.

3. The composition of claim 1, wherein said composition comprises less than about 25% by weight citric acid, based upon the total weight of the composition taken as 100% by weight.

4. The composition of claim 1, said composition further comprising sodium carbonate.

5. The composition of claim 4, said composition further comprising trisodium nitrilotriacetate monohydrate, sodium xylene sulfonate, and sodium lauryl sulfate.

6. The composition of claim 1, said composition further comprising trisodium nitrilotriacetate monohydrate.

7. The composition of claim 1, wherein said self-sustaining body comprises a tablet.

8. The composition of claim 1, wherein said composition is at least about 95% dissolved after about 3 minutes in water having a temperature of from about 115-125° F. and at concentrations of from about 0.3-1.5% by weight composition, based upon the total weight of the composition and water taken as 100% by weight.

9. A method of cleaning a substrate, said method comprising the steps of:

dissolving or dispersing a self-sustaining body in water to form a cleaning solution, said self-sustaining body being formed from a mixture being essentially free of binders, zeolite, and clay and comprising:

sodium bicarbonate;

citric acid;

an alkali metal alkylbenzene sulfonate;

an ingredient selected from the group consisting of a trialkyl glycol monoalkyl ether, limonene, and mixtures thereof; and a compound selected from the group consisting of sodium percarbonate, sodium perborate, and mixtures thereof; and contacting the cleaning solution with the substrate.

10. The method of claim 9, wherein said self sustaining body comprises a tablet.

11. The method of claim 9, wherein said cleaning solution comprises at least about 0.02% by weight $CO_2$, based upon the total weight of the cleaning solution taken as 100% by weight.

12. The method of claim 11, wherein said cleaning solution has a pH of from about 6.5-7.9.

* * * * *